US005195581A

United States Patent [19]

Puntambekar et al.

[11] Patent Number: 5,195,581

[45] Date of Patent: Mar. 23, 1993

[54] SNAP ON RADIATOR TANK

[75] Inventors: Girish K. Puntambekar; Karl P. Kroetsch, both of Williamsville, N.Y.

[73] Assignee: General Motors Corporation, Detroit, Mich.

[21] Appl. No.: 883,743

[22] Filed: May 15, 1992

[51] Int. Cl.[5] ..... F28F 9/04; B32B 7/12

[52] U.S. Cl. ..... 165/173; 165/175; 29/890.043; 156/91

[58] Field of Search ..... 165/173, 175, 149, 76, 165/78, 79; 29/890.052, 890.043, 451, 453, 458; 156/91, 92

[56] References Cited

U.S. PATENT DOCUMENTS

| | | | |
|---|---|---|---|
| 2,709,290 | 5/1955 | Rosenthal | 29/451 |
| 3,059,292 | 10/1962 | Harris | 29/453 |
| 3,106,759 | 10/1963 | Kytta | 29/453 |
| 3,367,809 | 2/1968 | Soloff | 156/91 |
| 4,360,969 | 11/1982 | Collier | 29/453 |
| 4,649,628 | 3/1987 | Allemandou | 165/173 |
| 4,651,815 | 3/1987 | Logic et al. | 165/76 |
| 4,651,821 | 3/1987 | Moranne | 165/173 |
| 4,738,308 | 4/1988 | Moranne | 165/173 |
| 4,997,035 | 3/1991 | Beatenbough et al. | 165/173 |

FOREIGN PATENT DOCUMENTS

| | | | |
|---|---|---|---|
| 17410 | 10/1980 | European Pat. Off. | 165/173 |

*Primary Examiner*—John Rivell
*Assistant Examiner*—L. R. Leo
*Attorney, Agent, or Firm*—Ronald L. Phillips

[57] ABSTRACT

A heat exchanger includes a pair of tank units with parallel tube and air centers connected therebetween. The tank units are comprised of a separate tank member and header. The header includes apertures for receiving the tubes, and side cavities. The cavities extend the length of the tank unit and include a base with apertures spaced therein and a side wall with receptacles formed therein. The tank member includes flanges to be received within the cavities. The flanges include a projection for mating with the receptacle and a snap tab received within the aperture to provide a snap-on connection between the tank member and the header. An adhesive is provided within the base to seal, reinforce and prevent corrosion in the tank and header joint.

4 Claims, 2 Drawing Sheets

SNAP ON RADIATOR TANK

TECHNICAL FIELD

The invention relates to heat exchangers of the type having a pair of tank units with parallel tubes and air center members therebetween for cooling the fluid within the tank units and tubes, and more particularly, to tank units including separate headers and tank plates and the connection therebetween.

BACKGROUND OF THE INVENTION

Heat exchangers, such as those used as radiators in vehicles, comprise a pair of tank units providing chambers therein for containing engine fluid or coolant. A plurality of parallel tubes are connected between the tank units with air centers provided therebetween for directing the flow of air through the radiator to conductively cool fluid within tubes as air passes through the air centers.

U.S. Pat. No. 4,651,815, issued Mar. 24, 1987 in the name of Logic et al, sets forth a tank of a plastic material with a header of a metal material. The joint between the dissimilar materials must be provided by a clamping force, due to the fact that brazing and soldering cannot be employed. The '815 patent discloses use of a groove in the header plate having a bottom wall surrounded by an upstanding wall which has spaced apertures therein. A compressible gasket is located in the groove. The plastic tank has a series of outwardly projecting lugs or fingers configured to be fitted within the grooves compressing the gasket so that the gasket effects the seal between the tank and the header plate. The fingers lock within the apertures.

U.S. Pat. No. 4,997,035, issued Mar. 5, 1991 in the name of Beatenbough et al discloses a connection for heat exchangers between the headers and tanks which utilizes a header providing a C-shaped channel and a tank providing an arm with a flange extending outwardly. The channel receives the arm for retaining the flange within the C-shaped channel and a seal is provided along the base of the channel.

SUMMARY OF THE INVENTION

The invention includes a tank and header assembly for a heat exchanger of the type having a pair of tank units with a plurality of parallel tubes and air centers connected therebetween for communicating liquid within the tank units and tubes to conductively cool fluid passing therein by air passing through the air centers. The assembly includes a separate tank and header. The header includes a body portion having first and second sides and center apertures therein to receive the tubes. The first and second sides each include a cavity having a side wall and a base perpendicular to one another. A plurality of pairs of first and second retaining members are spaced along the first and second sides at the cavity. The tank includes a pair of flanges extending therefrom. The flanges include a plurality of pairs of first and second snap members engageable with the retaining members to retain the tank against the header.

The invention further includes a first retaining member shaped as a semi-circular receptacle or cavity coacting with a first snap member shaped as a semi-circular projection. The second retaining member includes an aperture coacting with a second snap member shaped as a headed tab or snap.

BRIEF DESCRIPTION OF THE DRAWINGS

Advantages of the present invention will be readily appreciated as the same becomes better understood by reference to the following detailed description when considered in connection with the accompanying drawings wherein.

DESCRIPTION OF THE PREFERRED EMBODIMENT

Figure 1:
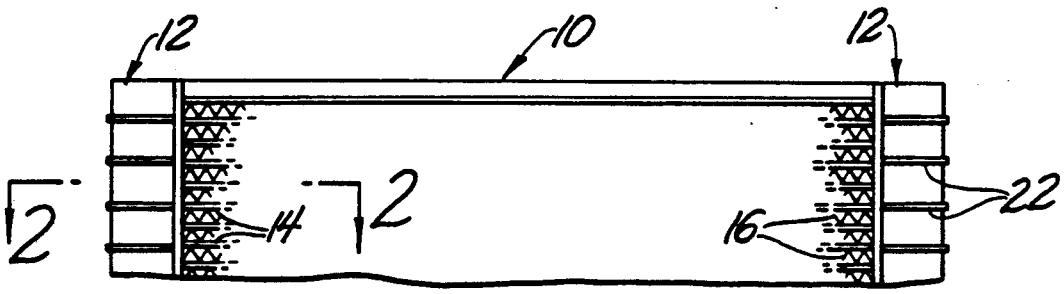
FIG. 1 is a partial front view of a radiator having a preferred embodiment of the tank units.
Figure 2:
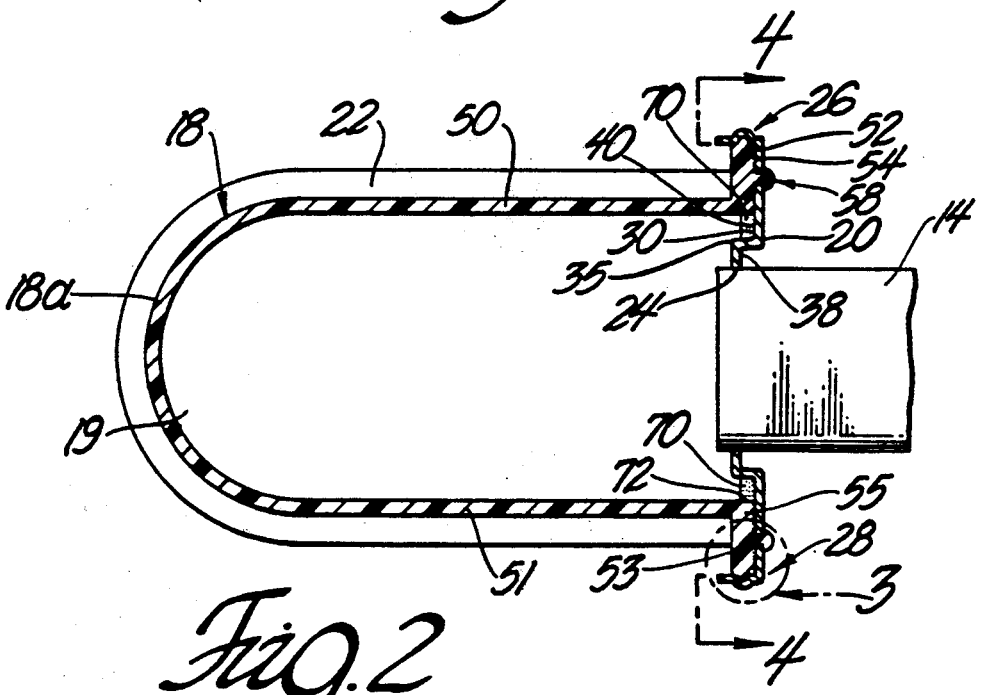
FIG. 2 is a cross sectional view taken along lines 2—2 of FIG. 1.

A heat exchanger 10 of the type utilizing a pair of tank units 12 is generally illustrated in FIG. 1. As is well known in the prior art suitable inlet and outlet fittings (not shown) are provided on the tank units 12 for connection to hoses in a coolant system.

The heat exchanger 10 comprises a plurality of flat sided tubes 14 arranged in parallel relationship. While flat tubes are shown, the invention is equally suitable for use in heat exchangers having tubes of other shapes, e.g., round tubes. Air centers 16 of sinusoidally bent thin metal with louvers therein are arranged between the flat tubes 14 for thermal coupling of the tubes with the air passing therethrough. The ends of the tubes 14 are connected to the tank units 12 in fluid communication therewith.

Each tank unit 12 is formed by a separate tank member 18 and a separate header 20. The tank member 18 extends longitudinally along the length of the tank unit 12 to provide, in conjunction with the header 20, a fluid chamber 19 for containing the engine fluid to be cooled, such as the coolant. The tank member 18 also includes reinforcing ribs 22 on its external side extending transverse thereabout to strengthen the tank member 18. The tank member 18 is generally comprised of a plastic material, as commonly known in the art.

The header 20 is typically formed of an aluminum material. The header 20 includes a plurality of slot apertures 24 for receiving the parallel tubes 14. The tubes 14 are generally brazed to the header 20 about the circumference of slots 24 to seal each of the tubes 14 within a slot 24 for preventing leakage of the coolant from the tank units 12.

Each header 20 includes a main centrally located wall 38 with the apertures 24 formed therein. Each header 20 further includes first and second longitudinal sides 26, 28 extending from the wall 38 each bent to defines side cavity portions 30, 32. The cavity portions 30, 32 each have an exterior side wall 34, 37 and an interior side wall 35, 36 connected to the main centrally located wall 38 of the header 20. The exterior side walls 34, 37 are formed at the sides 26, 28 of the header 20. The exterior side walls 34, 37 are parallel with one another and perpendicular to the planar or flat base 40, 42 of the cavity portions 30, 32.

The cavity portions 30, 32 each includes a plurality of pairs of retaining members 44, 46 spaced along the longitudinal length of the tank unit 12. More particularly, the first retaining members 44 each comprises a semi-circular receptacle or cavity 44 formed in the exterior side wall 34, 37 and projecting laterally outwardly from the cavity 30, 32. A second retaining member 46 is formed in the base 40, 42 and comprises an aperture 46 formed therein. The external side walls 34, 37 include notches 60 (FIG. 6) formed therein to allow for flexing of the exterior side walls 34, 37 during connection or insertion of the tank member 18 with the header 20, as subsequently discussed. The cavity portions 30, 32 receive an adhesive material 70 along the base 40, 42 there of to seal the header 20 with the tank member 18 along the joint therebetween, as subsequently discussed. The adhesive 70 may be of the type epoxy based adhesive, such as Goodrich structural adhesive, or form in place silicone seal by Dow-Corning.

Figure 3:
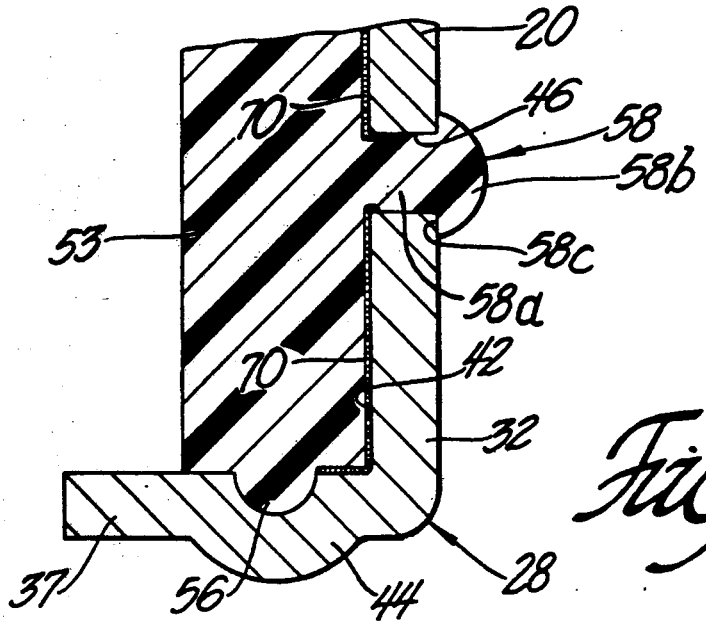
FIG. 3 is an enlarged view of circled region 3 in FIG. 2.

The tank member 18 is generally comprised of a U-shaped plastic extrusion having parallel arms 50, 51 connected by a semi-circular segment 18*a* providing the fluid chamber 19 therein. Flanges 52, 53 extend outwardly from and perpendicularly to the arms 50, 51 for the longitudinal length of the tank member 18. The flanges 52, 53 have respective flat surfaces 54, 55 each of a width less than the width of the bases 40, 42 for abutting against the bases 40, 42 so as to provide a sealed joint therebetween. The flanges 52, 53 include a plurality of pairs of first and second coacting members 56, 58 spaced along the length of the flanges 52, 53 for coacting with the retaining members 44, 46 to retain the tank member 18 against the header 20. More particularly, the first retaining member 56 comprises a semi-circular projection conforming to the contour of the semi-circular receptacle 44. The second coacting member 58 comprises a headed tab or snap for insertion within the aperture 46 and securement against the external side of the base 40, 42. The snap 58 includes a stem 58*a* having a length equal to the thickness of the header 20 and a diameter equal to the aperture 46 diameter. An enlarged semi-circular head 58*b* is attached to and integral with the stem 58*a*. The head 58*b* has an annular abutting surface 58*c* which flexes to allow the enlarged head 58*b* to snap through the aperture 46 and abut against the header 20 after insertion thereof to secure the tank member 18 with the header 20. FIG. 3 best illustrates the interconnection of the retaining members 44, 46 and coacting members 56, 58. The adhesive 70 flows during interconnection of the retaining members 44, 46 with the coacting members 56, 58 to fill any undesired gaps between the tank flanges 52, 53 and header base 40, 42 eliminating the possibility of crevice corrosion, as well as acting as a coolant seal in addition to preventing fatigue of the snaps 58 by limiting tank deflection during pressure cycling. The adhesive 70 flows and fills the remaining open cavity portion 72 for sealing and bonding.

Figure 4:
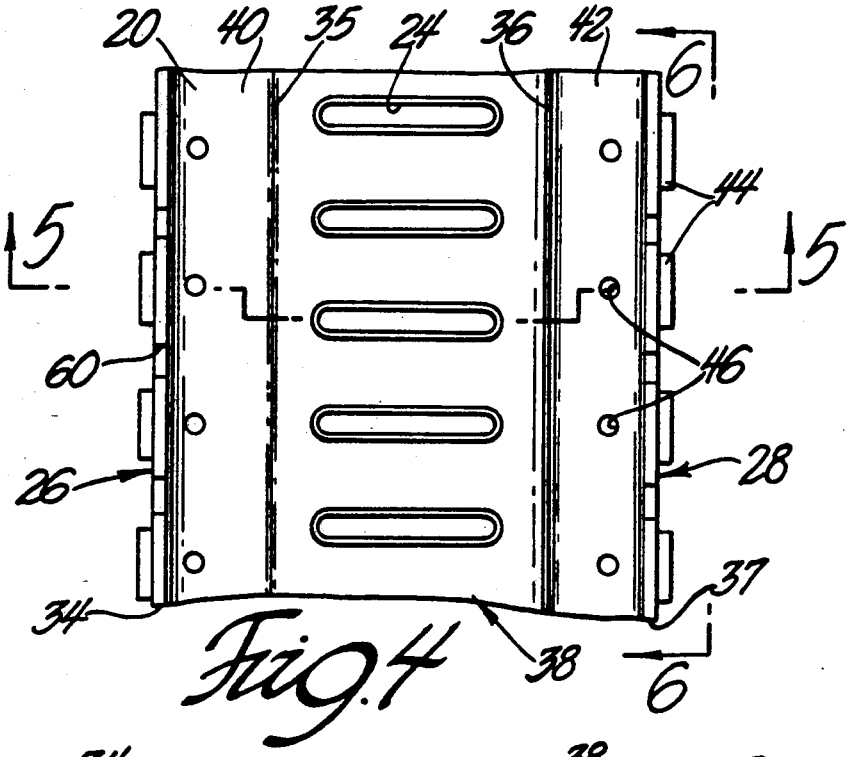
FIG. 4 is an elevational view of the header and parallel tubes along lines 4—4 of FIG. 2.
Figure 5:
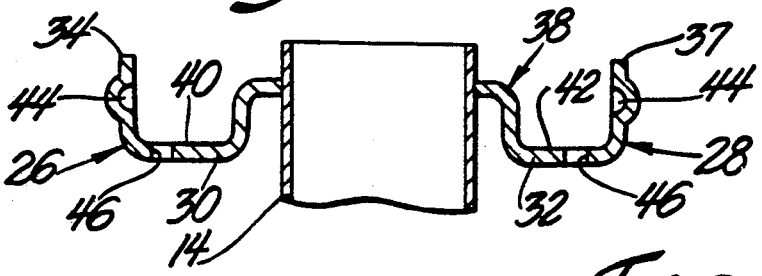
FIG. 5 is a cross sectional view taken along lines 5—5 of FIG. 4.
Figure 6:
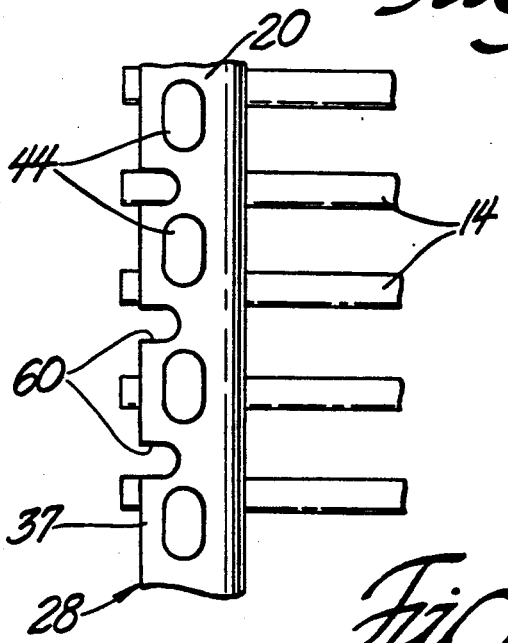
FIG. 6 is a side view taken along lines 6—6 of FIG. 4.

The retaining members 44, 46 and coacting members 56, 58 are aligned with one another and are spaced periodically along the length of the tank unit 12, i.e., every inch, as illustrated in FIGS. 4 and 6.

In operation, the radiator core comprising the parallel tubes 14, air center 16 and header 20 is first formed by assembly of the parallel tubes 14 to the header 20 within the tube apertures 24 thereof. The core is brazed to seal the joints therebetween. Thereafter, the adhesive 70 is evenly spread within the cavities 30, 32 along the bases 40, 42. The tank member 18 is pressed onto the radiator core at one of the headers 20. Due to the external force applied to the tank member 18, the adhesive 70 flows allowing the retaining members 44, 46 and coacting members 56, 58 to be coupled together forming the assembled tank units 12. The notches 60 allow the external side walls 34, 37 to flex as each projection 56 is fit within a receptacle 44. The adhesive 70 fills any undesired cavities in the header and tank joint, with the excess flowing into the open cavity portion 72.

It is to be understood that though the preferred embodiment is referenced to a radiator, other types of heat exchangers may utilize the present invention and are encompassed by the subject invention.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A tank and header assembly for a heat exchanger of the type having a pair of tank units with a plurality of tubes and air centers connected therebetween for communicating fluid through the tank units and tubes to conductively cool the fluid passing therethrough as air is passed over the air centers, said assembly comprising:

a separate tank member and header;

said header including a body portion having first and second sides and apertures therein to receive the tubes, said first and second sides each including a cavity having a side wall and a base perpendicular to one another, said cavity including a plurality of pairs of first and second retaining members spaced along said first and second sides;

said tank including a pair of flanges extending therefrom, said flanges including a plurality of pairs of first and second snap members for coacting with said pairs of retaining members to retain said tank against said header.

2. An assembly as set forth in claim 1 wherein said side wall includes said first retaining members and said base includes said second retaining members, said flanges providing a flat surface abutting against said base and having a width less than the width of said base.

3. A tank and header assembly for a heat exchanger of the type having a pair of tank units with a plurality of tubes and air centers connected therebetween for communicating engine fluid through the tank units and tubes to conductively cool the fluid passing therethrough as air is passed over the air centers, said assembly comprising:

a separate tank member and header;

said header including a body portion having first and second sides with apertures therein to receive the tubes, said first and second sides each including a cavity having a side wall and a base perpendicular to one another, said cavity including a plurality of pairs of first and second retaining members spaced along said first and second sides;

said tank including a pair of flanges extending therefrom, said flanges including a plurality of pairs of first and second snap members for coacting with said pairs of retaining members to retain said tank to said header;

said first retaining member comprising a semi-circular receptacle formed within said side wall; said second retaining member comprising an aperture formed within said base; said first snap member comprising a semi-circular projection conforming to the contour of said first retaining means for abutting thereagainst to maintain said tank member against said header; said second snap member comprising a headed tab for reception within said aperture to allow for insertion thereof and prevent separation of said header and said tank.

4. A tank and header assembly for a heat exchanger of the type having a pair of tank units with a plurality of tubes and air centers connected therebetween for communicating fluid through the tank units and tubes to conductively cool the fluid passing therethrough as air is passed over the air centers, said assembly comprising:

a separate tank member and header;

said header including a body portion having first and second sides and apertures therein to receive the tubes, said first and second sides each including a cavity having a side wall and a base perpendicular to one another, said cavity including a plurality of pairs of first and second retaining members spaced along said first and second sides;

said tank including a pair of flanges extending therefrom, said flanges including a plurality of pairs of first and second snap members for coacting with said pairs of retaining members to retain said tank against said header, and adhesive means within said cavity adjacent said flanges for adhering and sealing said header with said tank.

* * * * *